US006364219B1

(12) United States Patent
Zimmerman et al.

(10) Patent No.: US 6,364,219 B1
(45) Date of Patent: Apr. 2, 2002

(54) BLADDER WATER GUN WITH SHAPED STREAM DISCHARGE ORIFICES

(75) Inventors: Jeffrey Zimmerman, King of Prussia, PA (US); Jay E. Campbell, Lexington, SC (US)

(73) Assignee: Larami Limited, Mount Laurel, NJ (US)

( * ) Notice: Subject to any disclaimer, the term of this patent is extended or adjusted under 35 U.S.C. 154(b) by 0 days.

(21) Appl. No.: 09/591,379

(22) Filed: Jun. 9, 2000

Related U.S. Application Data

(60) Provisional application No. 60/138,885, filed on Jun. 11, 1999.

(51) Int. Cl.[7] ..... A62C 31/02
(52) U.S. Cl. ..... 239/394; 222/79; D21/572
(58) Field of Search ..... 239/394; 222/79; D21/572

(56) References Cited

U.S. PATENT DOCUMENTS 5,303,868 A * 4/1994 Kroll ..... 239/394
5,531,627 A * 7/1996 Deal ..... 222/79 X
5,630,548 A * 5/1997 Chih ..... 239/394
5,799,827 A * 9/1998 D'Andrade ..... 222/79
5,873,531 A * 2/1999 Wang ..... 239/394
D421,467 S * 3/2000 D'Andrade et al. ..... D21/572

* cited by examiner

*Primary Examiner*—Lesley D. Morris
(74) *Attorney, Agent, or Firm*—Akin, Gump, Strauss, Hauer & Feld, L.L.P.

(57) ABSTRACT

A toy gun for discharging a shaped stream of liquid under pressure is provided. The toy gun includes an expandable bladder located in a housing, and the expandable bladder is adapted to provide a generally constant pressure discharge of liquid contained therein. A release valve is connected to a trigger for regulating a discharge of liquid from the expandable bladder to a discharge outlet. A turret mounted rotatable nozzle assembly having a plurality of nozzles is connected to the housing. Each nozzle is selectively rotatable to a position in fluid communication with the discharge outlet. At least two of the plurality of nozzles include different shaped, non-circular stream nozzle orifice arrangements. Actuation of the trigger regulating the release of pressurized liquid through the discharge outlet and the selected one of the plurality of nozzles results in the liquid being discharged in a shaped stream having a generally constant form defined by the shape of the selected nozzle orifice arrangement.

15 Claims, 4 Drawing Sheets

FIG. 2
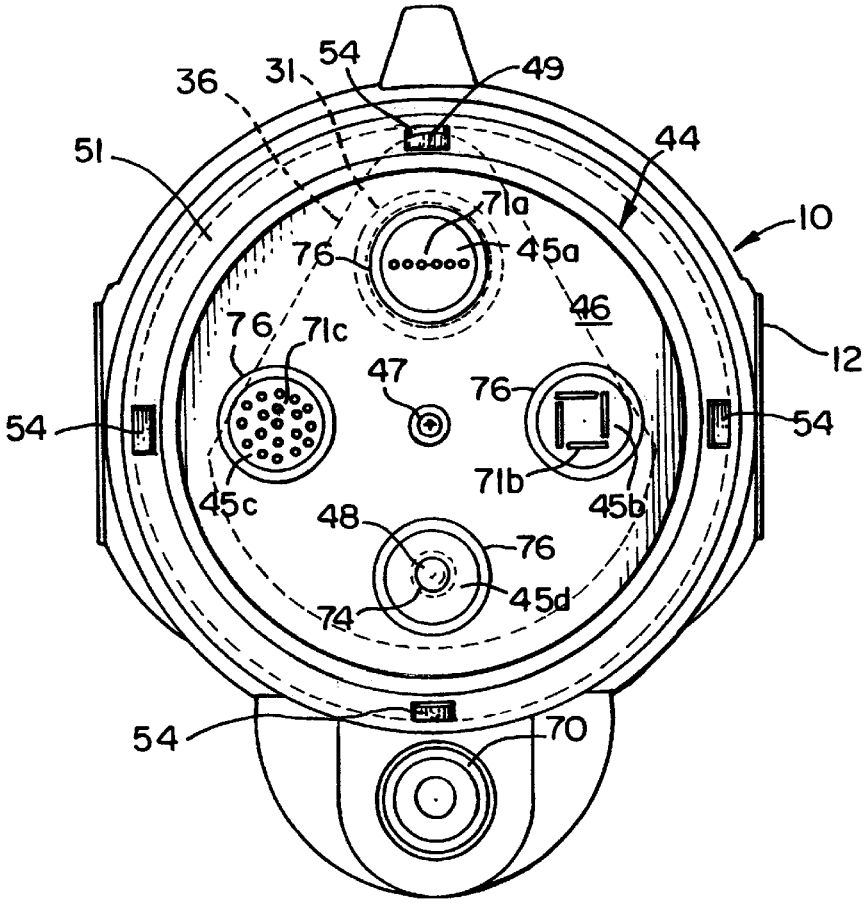
FIG. 4
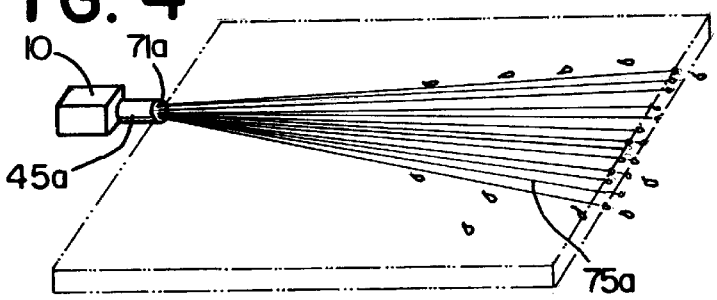
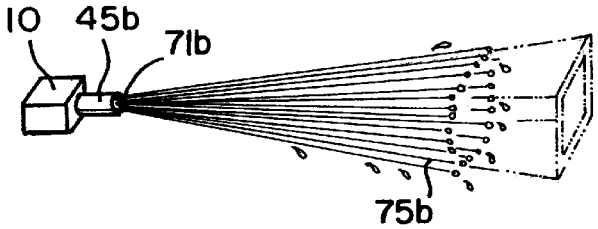
FIG.5

BLADDER WATER GUN WITH SHAPED STREAM DISCHARGE ORIFICES

CROSS-REFERENCE TO RELATED APPLICATIONS

This application claims the benefit of U.S. Provisional Patent Application No. 60/138,885, filed Jun. 11, 1999.

BACKGROUND OF THE INVENTION

The present invention is directed to toy water guns having at least one expandable bladder for discharge of a liquid under pressure, and more particularly, to a toy water gun having an expandable bladder which can deliver a high volume of water at a relatively high and constant pressure through one of a selectable number of shaped stream discharge orifices to produce a pattern shaped water discharge.

Bladder water guns having an on-board pump are known, such as disclosed in U.S. Pat. No. 5,799,827, which is assigned to the assignee of the present invention, and is incorporated herein by reference as if fully set forth. Such water guns have proven to be extremely popular and successful in the market. One known water gun of this type, the CPS™ 3000, which is marketed by the assignee of the present invention, provides a selectable nozzle arrangement having four nozzles mounted on a manually rotatable turret. A selected nozzle can be aligned with an outlet opening prior to discharging water from the water gun. Three of the nozzles are each provided with a single round opening of a different size in order to change the volume and intensity of the discharge stream. A fourth nozzle is provided with an opening as shown in FIG. 8, which produces a high volume generally round "blast" stream which is bigger than the largest of the three single round opening nozzles.

It is also known to provide bladder water guns with a rapid charging capability without the need for pumping if an external pressurized water source, such as public water, is available, as disclosed in U.S. patent application Ser. No. 09/227,066, filed Jan. 5, 1999, which is incorporated herein by reference as if fully set forth. This provides for enhanced enjoyment and ease of use, especially for younger users who may have more difficulty using the manual pump, and allows for faster recharging of the toy gun. These guns allow a user to pressurize the water gun using a manual pump located on the gun when an external source of pressurized water is not available.

This recent bladder gun technology is approaching the limit on how much water can be carried by a user and discharged in a single "shot", as well as practical limits on distance and stream continuity while still maintaining a relatively inexpensive toy which can be used by children. It would be desirable to provide additional features for a water gun in order to develop more interest on the part of users.

SUMMARY OF THE INVENTION

Briefly stated, the present invention relates to a toy gun for discharging a shaped stream of liquid under pressure, comprising:

a housing;

an expandable bladder located in the housing, the expandable bladder being adapted to provide a generally constant pressure discharge of liquid contained therein;

a trigger connected to a release valve for regulating discharge of liquid from the expandable bladder to a discharge outlet; and a turret mounted rotatable nozzle assembly having a plurality of nozzles connected to the housing, each nozzle being selectively rotatable to a position in fluid communication with the discharge outlet, at least two of the plurality of nozzles including different shaped, non-circular stream nozzle orifice arrangements, wherein actuation of the trigger regulating the release of pressurized liquid through the discharge outlet and the selected one of the plurality of nozzles results in the liquid being discharged in a shaped stream having a generally constant form defined by the shape of the selected nozzle orifice arrangement.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 2 is a front view of the water gun shown in FIG. 1 taken along lines 2—2 in FIG. 1;

FIG. 4 is a perspective view of a first shaped stream discharge from a first nozzle of the preferred embodiment of the water gun shown in FIG. 1;

FIG. 5 is a perspective view of a second shaped stream discharge from a second nozzle of the preferred embodiment of the water gun shown in FIG. 1;

DETAILED DESCRIPTION OF THE INVENTION

Figure 1:
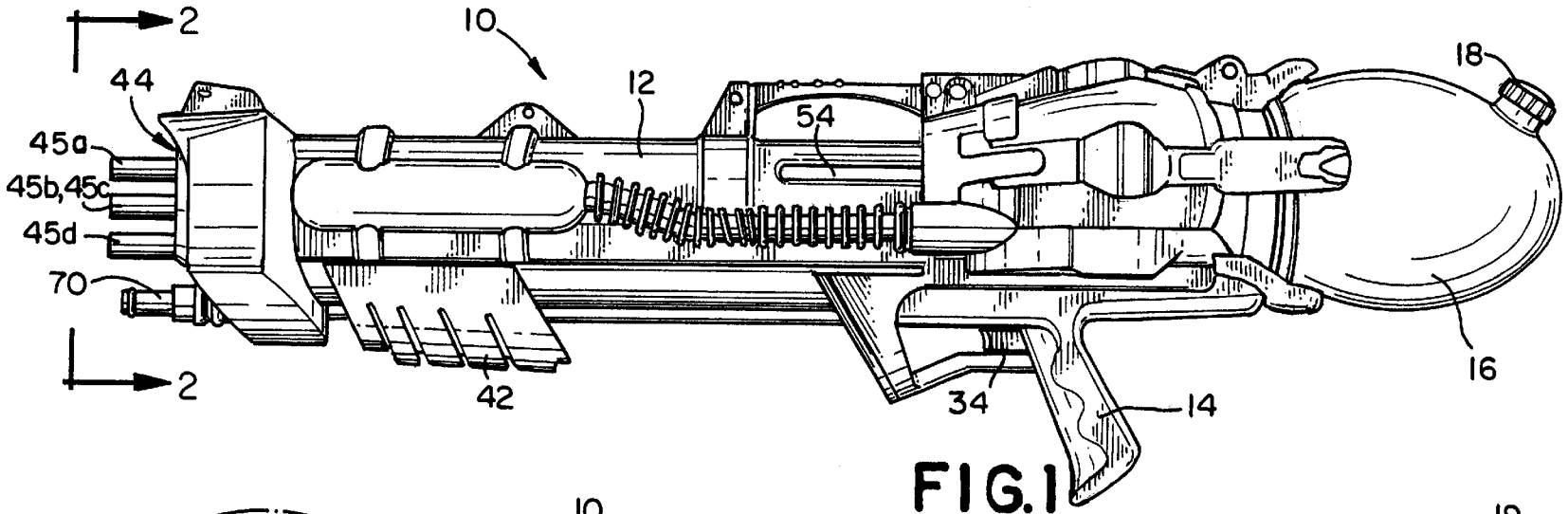
FIG. 1 is a right side elevational view of a water gun in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy water gun in accordance with the present invention, and designated parts thereof. The terminology includes the words noted above as well as derivatives thereof and words of similar import.

As used herein, unless otherwise indicated, the article "a" or "an" identifies and relates to one or at least one of the element(s) to which it refers.

Referring to the drawings, wherein like numerals indicate like elements throughout, there is shown in FIGS. 1–3 and 3*a,* a water gun 10 in accordance with the present invention. While the preferred embodiment of the invention is preferably a water gun, it will be recognized by those skilled in the art that the toy gun 10 can be used with any liquid. For the sake of convenience, the preferred embodiment will therefore be described as a water gun, although this is not intended to limit the present invention from use with other liquids. As shown in detail in FIGS. 1–3, and 3*a,* the water gun 10 includes a housing 12 having a handle 14 which can be grasped by a user. Preferably, the housing 12 and handle 14 are molded from a polymeric material in one or more pieces, and are assembled together to form the housing 12. However, it will be recognized by those skilled in the art in view of the present disclosure that the housing 12 may be made using any desired method, such as machining, and from any other suitable material, as desired.

A storage tank 16 having a cap 18 is attached to the housing 12. Preferably, the storage tank 16 is molded from a polymeric material, but any other suitable material may also be used. The cap 18 is engaged to the tank 16 via threads. Preferably, the cap 18 includes a vent opening 19, as shown in FIG. 3, and a two-way rubber vent is located within the cap 18 to allow air to enter and exit the tank 18.

A tubular inner housing 20 is located in the housing 12. The tubular inner housing 20 is preferably formed from a polymeric material and includes a smooth interior surface having a constant diameter. As before, other suitable materials may be used. The tubular inner housing 20 has an opening 21 through which an expandable bladder 52 is inserted, as explained in more detail below. The tubular inner housing 20 is designed to have sufficient strength to prevent radially directed over expansion of the expandable bladder 52 to prevent over pressurization of the expandable bladder 52 and damage to the housing 12. However, it will be recognized by those skilled in the art in view of the present disclosure that the inner housing 20 can be omitted, and the main housing 12 can be designed to accommodate the bladder 52 and prevent over pressurization.

The bladder 52 is preferably an elastic, tubular bladder of the type disclosed in U.S. Pat. Nos. 5,799,827 and 5,758,800, which are incorporated herein by reference as if fully set forth, and which are assigned to the assignee of the present invention. The bladder preferably is molded from a natural rubber. However, other shapes and styles of bladders may be used, if desired. The bladder 52 preferably includes a wall having a reduced cross-sectional area adjacent to the opening 54 to promote initial expansion in the area of the opening 54 prior to the reminder of the bladder 52 expanding to fill the reminder of the pressure chamber 20. It will be recognized by those skilled in the art in view of the present disclosure, that the bladder 52 may be made from other suitable materials, if desired, and that the shape can be varied to suit various pressure chamber dimensions. Significantly, by providing a bladder 52 which has a straight tapered profile, manufacturing costs can be reduced based on the use of a two piece mold such that the bladder 52 being easily released from the male and female mold parts.

Figure 3:
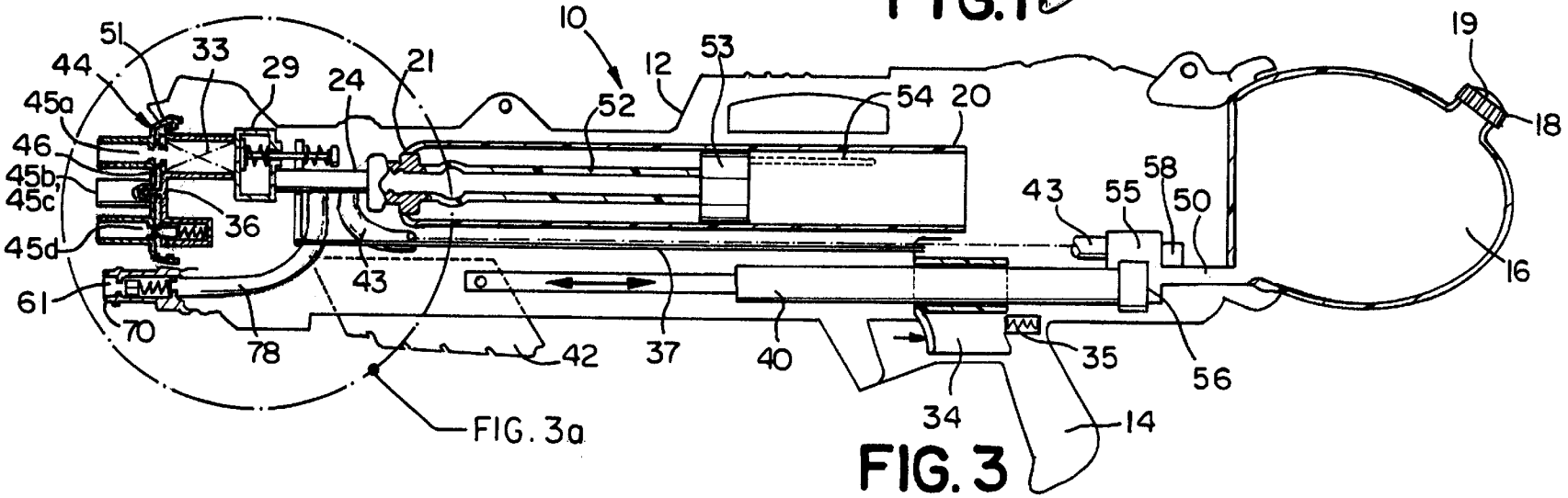
FIG. 3 is a vertical cross-sectional view of the toy water gun shown in FIG. 1.
Figure 3A:
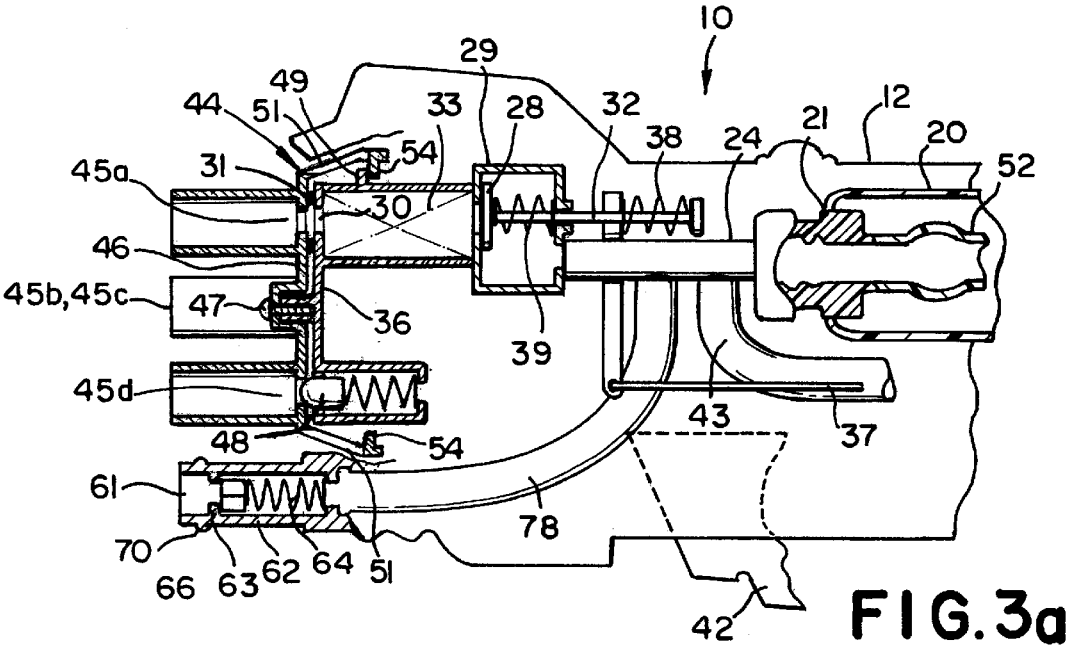
FIG. 3*a* is an enlarged view of the circled portion marked 3*a* of the toy water gun shown in FIG. 3.

As shown in detail in FIGS. 3 and 3*a,* a release valve 28 is located in a release valve chamber 29 disposed in the housing 12 at the front of the water gun 10, and is connected to the expandable bladder 52 via a path of fluid communication which includes a first pipe 24. The first pipe 24 has a first end and a second end. The first pipe 24 can be made from any material in any manner as long as the material has the ability to deliver liquid from one end to the other. The release valve 28 is similar to the valve disclosed in U.S. Pat. No. 5,799,827, which is incorporated herein by reference as if fully set forth. A stem 32 extends from the release valve 28 for opening the valve release 28 to discharge water or any other desired liquid from an outlet 30 and through one of a plurality of nozzles, exemplified by four nozzles 45*a,* 45*b,* 45*c,* 45*d,* of a turret mounted rotatable nozzle assembly 44 at the front of the housing 10.

The release valve 28 is actuated via a trigger 34 which is arranged for movement within the housing in any suitable manner, such as by sliding along a pump and within an appropriate slot formed in the housing 12 adjacent to the handle 14. The trigger 34 is biased to a first position via a spring 35 and is connected by a linkage 37 to the valve stem 32. Actuation of the trigger 34 by moving the trigger backwards toward the handle 14 causes the valve stem 32 to be retracted via compression of a delay spring 38 connected between the stem 32 and the linkage 37 until a sufficient force is attained to compress the return spring 39 located in the release valve chamber 29. This opens the release valve 28 and thereby allows a discharge of liquid from the expandable bladder 52. The liquid discharged from the bladder is ejected from the gun 10 as a stream of liquid from a selected nozzle 45*a*–45*d*. However, it will be recognized by those skilled in the art in view of the present disclosure that other types of release valves 28 may be used, such as a pinched tube valve, and that the present invention is not limited to the specific valve 28 or linkage arrangement disclosed.

Preferably a laminar flow device 33 is located between the release valve 28 and the outlet 30 to provide a laminar flow of liquid with reduced turbulence to the selected nozzle 45*a*–45*d*. Such devices are generally known to those skilled in the art, and accordingly, have not been described here in further detail. An example of a suitable laminar flow device that could be used herein is disclosed in U.S. Pat. No. 5,779,099, which is assigned to the assignee of the present invention. The disclosure of U.S. Pat. No. 5,779,099 is incorporated herein as if fully set forth.

Referring now more particularly to FIGS. 2 and 3*a,* the turret mounted rotatable nozzle assembly 44 will be described in more detail. The nozzle assembly 44 includes a turret 46 upon which the nozzles 45*a*–45*d* are located. The turret has a front surface from which the nozzles extend, and a cirumferential side wall or flange 51 extending from the rear wall of the turret 46. The circumferential side wall 51 of the turret is preferable angled outwardly and rearwardly. The turret 46 is rotatably mounted on a turret support member 36 via a centrally located fastener 47, such as a screw, a rivet or other rotatable connection. The nozzles 45*a,* 45*b,* 45*c,* 45*d* are circumferentially and preferably evenly spaced about the periphery of the turret 46, as shown in FIG. 2.

While in the preferred embodiment, four nozzles 45*a*–45*d* are shown, it will be recognized by those skilled in the art in view of the present disclosure that a different number of nozzles, such as five, six or eight could be utilized, depending on the space available on the turret. The nozzles should have different shapes or sizes so that different spray or stream patterns are created when liquid is discharged from the gun. At least two of the nozzles, and preferably at least three of the nozzles, have different shaped, non-circular orifice arrangements, such as those disclosed below in more detail. Additionally, it is also possible to provide multiple liquid outlets 30 in the turret support member 36, in connection with two or more turret mounted rotatable nozzle assemblies 44, on a single water gun which can be supplied with pressurized liquid from one or more bladders 52. Where two or more turret mounted rotatable nozzle assemblies are used, the discharge through the outlets 30 can be regulated by one or more release valves 28 connected to one or more trigger arrangements for single or multiple stream discharges.

The nozzles 45*a*–45*d* are located at a fixed radial distance from the center of the turret 46 such that they can be selectively rotated to the location of the outlet 30. As shown in FIGS. 2 and 3*a,* preferably an O-ring seal 31 is located in a groove surrounding the outlet 30, to seal against the rear face of the turret 46 around the selected nozzle 45*a*–45*d,* and thereby at least minimize and preferably prevent leakage of liquid from the outlet 30 between the turret 44 and the turret support member 36. To assure that a sufficient seal is created, a retention arrangement is provided. The retention arrangement includes a retainer element 49 preferably attached to, and preferably unitarily formed as a single unit with the turret support member 36 in the vicinity of the outlet 30. The retention arrangement further includes a plurality of tabs 54, each tab 54 being aligned with a nozzle 45*a*–45*d* and extending from the periphery of the turret 46 so as to bear against the rear surface of the retainer element 49 when the associated nozzle is rotated to be in alignment with the outlet 30. When a tab 54 bears against the retainer element 49, the rear surface of the turret is held more tightly against the O-ring 31 than would be possible without such a retention arrangement.

A spring loaded detent mechanism 48 is used to hold the selected nozzle 45*a*–45*d* in an aligned position with the outlet 30. Preferably, the detent mechanism 48 protrudes into the rear of one of the non-selected nozzle orifices 45*a*–45*d* in order to index and hold the selected nozzle orifice 45*a*–45*d* in an aligned position with the outlet 30.

As shown in FIGS. 2, each nozzle 45*a*–45*d* includes a nozzle orifice arrangement exemplified in FIG. 2 by nozzle orifice arrangements 71*a*–71*c* being in the form of a non-circular stream or spray arrangement, and one of the plurality of nozzle orifice arrangements being in the form of a standard circular orifice 74. Liquid is provided under pressure from the bladder 52 to the outlet 30 and through the selected nozzle 45*a*–45*d* at a relatively high and generally constant pressure during discharge, such that the liquid is discharged (shown schematically in FIGS. 4–6) through the nozzle orifice in a shaped stream 75*a*–75*c*. having a generally constant form corresponding to the shape of the respective nozzle orifice arrangement 71*a*–71*c*.

As used herein, the term "generally constant pressure" means a pressure created by the force of the contracting elastic bladder that propels the liquid out of the nozzle orifice substantially the same distance until the bladder is almost fully contracted. Thus, except for a short time just before the bladder is fully contracted, the pressure exerted on the liquid by the bladder is about the same. As used herein with respect to the shaped stream of liquid being discharged through the nozzle orifice arrangements, the term "generally constant form" means that the shape of the liquid stream exiting the gun is defined by the shape of the orifice arrangement through which the liquid is discharged for a considerable distance, such as several feet or meters. The distance cannot be exactly stated, since the distance the liquid is capable of traveling, while maintaining a shape defined by the corresponding orifice is primarily a function of the pressure exerted on the liquid by the elastic bladder, the size of the outlet 30 in the turret support member 36 through which the liquid is discharged, and the size and shape of the nozzle orifice arrangement through with the liquid is discharged. As noted in the description of FIGS. 7*a*–7*s* below, the defined shape of the stream or spray may not be the exact shape of the orifice arrangement. Where the shape differs, it is believed to be due to presently unknown hydraulic forces. Nevertheless, the shape of the stream or spray is reproducible and can be determined empirically. As a result, such streams or sprays which differ from the shape of the nozzle orifice arrangement will be considered herein to be of a "generally constant form." The shape of the liquid stream should be maintained in the reproducible shape or pattern defined by the nozzle orifice arrangement for at least about 70%, preferably at least about 75%, and more preferably at least about 80% of the range of any particular gun. The range is the maximum distance that the liquid will travel when being discharged from the gun.

Figure 7A:
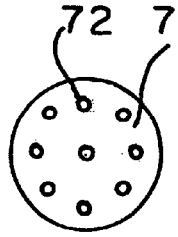
FIGS. 7*a*–7*s* are a number of front elevational views of additional, alternative shaped stream discharge orifices for producing shaped stream discharges from any of the nozzles of the preferred embodiment of the water gun shown in FIG. 1.

The shaped stream producing orifice arrangements 71 can have a varying number of individual orifices 72, orifices arranged in different patterns or oriented at an angle to the turret 46 to produce a wide variety of patterns. Alternatively, a non-circular shaped stream producing single orifice 73 can be utilized, as shown in FIGS. 7*a*–7*s*. Such arrangements are not believed to have been previously known or used in connection with bladder water guns.

As shown in FIG. 2, preferably, only a single, standard, circular-cross sectional shaped orifice 74 is provided, and at least two, and more preferably three non-circular shaped stream producing orifices 71*a*–71*c* are provided. However, the use of a turret mounted rotatable nozzle assembly 44 having six nozzles 45 would allow the use of more than one of the previously known circular nozzle orifices 74 having different sizes to produce different sized regular circular streams. Nozzle tubes 76 extending from the front surface of the turret 46 are preferably arranged around nozzle orifices 71*a*–71*c* and 74. If desired, any or all of the tubes 76 could have a front wall in which the desired orifice arrangement could be formed by molding or machining operations. This is the preferred location of the orifice arrangements. Alternatively, the orifice arrangements could be formed in discs recessed in the tubes 76 or in the base of the turret 46 aligned with the tubes 76. If desired, tubes 76 could be eliminated, but preferably they are not.

Figure 6:
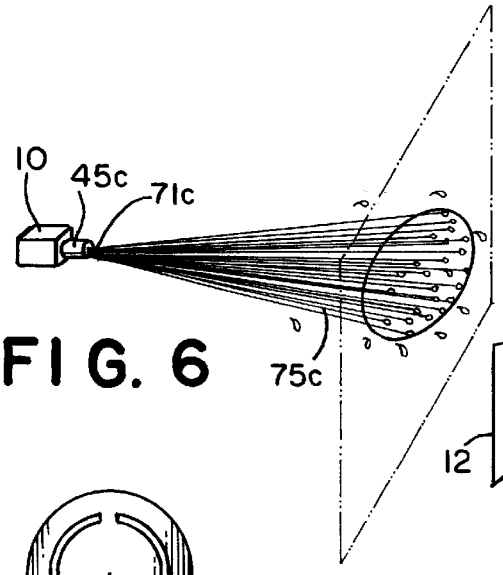
FIG. 6 is a perspective view of a third shaped stream discharge from a third nozzle of the preferred embodiment of the water gun shown in FIG. 1.
Figure 8:
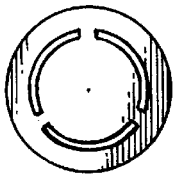
FIG.8 PRIOR ART
FIG. 8 is a front elevational view of a known prior art discharge orifice which produced a high volume, generally round blast stream similar to a single round orifice nozzle.

FIGS. 4–6 show the shaped streams produced by three preferred nozzle orifice arrangements 71*a*–*c* of FIG. 2. FIG. 4 shows a flat plane shaped stream produced by nozzle orifice arrangement 71*a* having a plurality of individual orifices 72. A large percentage of the water which is discharged remains generally in a plane for a considerable distance from the water gun 10, represented in diagrammatic form in phantom lines as a slab or short, wide box. FIG. 5 shows the generally rectilinear, preferably square shaped stream produced by the nozzle orifice arrangement 71*b* having four oblong rectangular orifices arranged in a square cross-sectional orifice arrangement. Most of the water maintains the square shaped stream, illustrated in phantom lines, for a considerable distance from the gun. FIG. 6 shows the a generally enlarged spread shower streams corresponding to the nozzle orifice arrangement 71*c* having a plurality of orifices 72. These nozzle orifice arrangements 71*a*–71*c* provide shaped streams having a generally constant form during liquid discharge, such as those shown in FIGS. 4–6, in order to provide a water gun 10 with more entertainment or play value than water guns that just provide a single, generally circular, "solid" uniform stream of a given size, as contrasted with a spray such as arrangement 71*c*.

The nozzle orifice arrangements 71*d*–71*v* illustrated in FIGS. 7*a*–7*s,* respectively, produce a plurality of different shaped stream arrangements corresponding to the respective nozzle orifice arrangements as described below. Where dimensions are set forth, they were measured at a distance of about 30 feet from the nozzle of the gun used to produce the shaped stream arrangements.

Figure 7B:
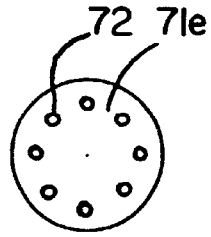
Figure 7C:
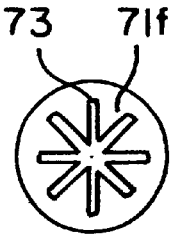
Figure 7D:
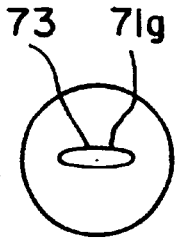
Figure 7E:
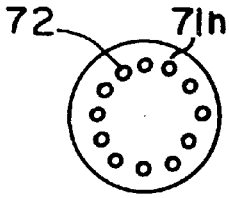
Figure 7F:
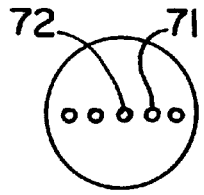
Figure 7G:
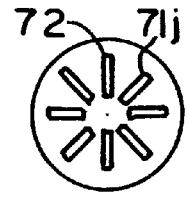
Figure 7H:
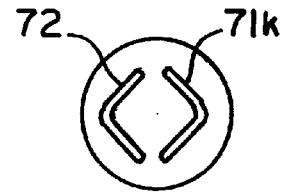
Figure 7I:
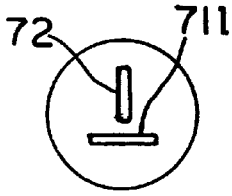
Figure 7J:
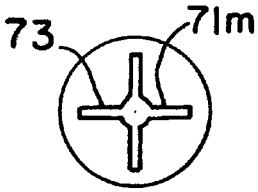
Figure 7K:
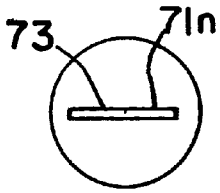
Figure 7L:
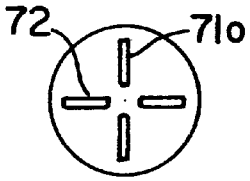
Figure 7M:
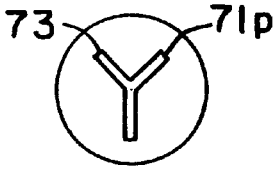
Figure 7N:
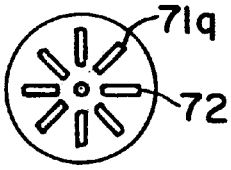
Figure 7O:
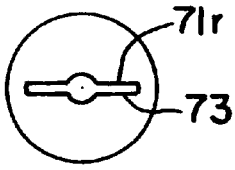
Figure 7P:
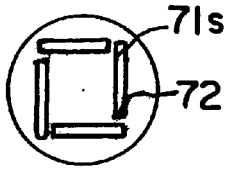
Figure 7Q:
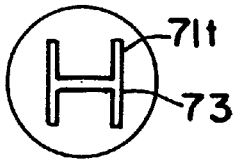
Figure 7R:
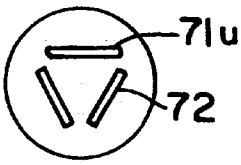
Figure 7S:
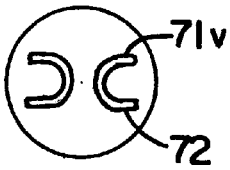

| FIG. No. | Nozzle Arrangement No. | Description |
|---|---|---|
| FIG. 7a | 71d | Nine stream close circular 3 ft. diameter pattern |
| FIG. 7b | 71e | Eight stream circular 10 ft. diameter pattern |
| FIG. 7c | 71f | Wide radial spoke spray with center stream |
| FIG. 7d | 71g | Heavy H-shaped spray |
| FIG. 7e | 71h | Heavy twelve stream hollow circular spray |
| FIG. 7f | 71i | Five separate stream fan out to 15 ft. wide |
| FIG. 7g | 71j | Heavy blast stream |
| FIG. 7h | 71k | Narrow fan shaped stream |
| FIG. 7i | 71l | Single medium stream |
| FIG. 7j | 71m | Light cross-shaped spray |
| FIG. 7k | 71n | Flattened fan 90° to vertical orientation |
| FIG. 7l | 71o | Single medium stream |
| FIG. 7m | 71p | Y-shaped spray |
| FIG. 7n | 71q | Heavy stream |
| FIG. 7o | 71r | H-shaped fan spray |
| FIG. 7p | 71s | Larger square shaped spray |
| FIG. 7q | 71t | H-shaped spray |
| FIG. 7r | 71u | Five fi. diameter spray |
| FIG. 7s | 71v | Loose center stream with side spray |

These embodiments are only intended to be exemplary. The present concept of providing multiple shaped stream forming nozzles to produce a shaped stream liquid discharge in order to provide additional play value in a toy bladder water gun could also encompass other orifice arrangements which provide a desirable pattern.

The operation of the gun will now be described. Referring again to FIG. 3, the path of fluid communication provides fluid communication between the expandable bladder 52, the outlet 30 and the pump 40. The path of fluid communication is a configuration of at least two pipes, and preferably, the first pipe 24, a second pipe 43 and a third pipe 50, as explained in more detail below.

The pump 40 is attached to the housing 12 and is in fluid communication with the liquid storage tank 16. The pump 40 includes a pump handle 42 which extends from the front of the water gun 10, although other orientations could be used if desired. A user grasps the pump handle 42 to manually pump water from the liquid storage tank 16 through the path of fluid communication and into the expandable bladder 52 located in the tubular inner housing 20 for charging the expandable bladder 52, such that the bladder 52 is expanded by liquid under pressure. If desired, the path of fluid connection could lead to a back pack or other liquid container, or to a dip tube having an open end that could be immersed in an open container or body of liquid, such as a swimming pool, pond or other such body of water, for example.

A carriage assembly 53 is attached to the second, closed end of the bladder 52, and guides the second end of the bladder 52 within the inner housing 20 as the bladder 52 expands. While a carriage assembly 53 which slides along the tubular housing 20 is preferred, other types of guides for the end of the bladder 52 may be provided, or the carriage assembly can be omitted depending on the bladder configuration. A sight window 54 is preferably provided in the housing 12 to show the charge level of the bladder 52 based upon the carriage position. The pump 40 could be any pump including portable pumps, piston or even a battery operated pump if desired and may be integral within the gun housing 12 or separate and remote from the housing 12. The pump 40 is connected to the storage tank via a third pipe 50, shown in FIG. 3, which is connected via a manifold 55 to a pump valve assembly 56. The pump valve assembly 56 includes a first check valve which allows water or other liquid to be drawn from the storage tank 16 or other source of liquid, through the third pipe 50, into the manifold 55 and into a chamber of the pump 40, as the pump handle 42 is moved in a forward direction away from the gun handle 14. As the handle 42 of the pump 40 is pressed inwardly toward the gun handle 14, the first check valve within the pump valve assembly 56 closes and a second check valve opens, allowing liquid to be discharged from the pump 40 to the second pipe 43, which is connected to the first pipe 24.

With the release valve 28 in the closed position, the water from the storage tank 16 or other source is moved under pressure from the pump 40 into the bladder 52, which expands. The check valves within the valve assembly 56 prevent back flow of water from the expandable bladder 52 into the pump 40. When the trigger 34 is pulled and the valve 28 is opened, water is discharged through the first pipe 24 through the release valve 28 and the discharge opening 30 to the selected nozzle 45*a*–45*d*. The first, second and third pipes 24, 43 and 50 can be made from any suitable material in any manner as long as the pipes have the ability to deliver liquid from one end of the path of fluid communication to the other.

Referring again to FIG. 3, a pressure release valve 58 is also connected to the path of fluid communication to prevent over pressurization of the bladder 52. The pressure release valve 58 prevents over pressurization of the bladder 52 during quick charging of the water gun 10 using an external source of pressurized water, such as pressurized tap water provided by a well pump or water pressure from a municipal water supply, as explained in detail below.

Figure 9:
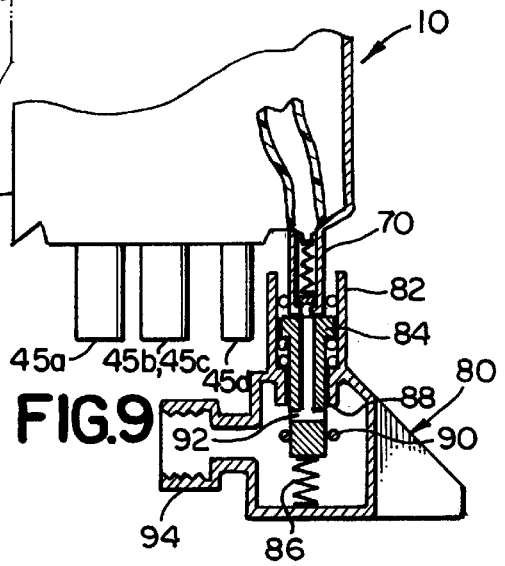
FIG. 9 is a partial cross-sectional view of the recharge nozzle assembly of a water gun of the present invention inserted in a recharge adapter.

With further reference to FIGS. 3 and especially 3*a,* a recharge nozzle assembly 70, which allows quick charging of the water gun 10 is shown. The recharge nozzle 70 is also shown in FIG. 9, with a charge valves in the open, charging position in a hose adapter or quick charge device 80. The recharge nozzle assembly 70 includes a housing 62, and a recharge opening 61. A pressure actuated charge valve 63 is located in the housing 62. The charge valve 63 is biased by a spring 64 to a forward most, normally closed position within the nozzle housing 62. The outside of the housing 62 includes a groove at the forward end in which an O-ring seal 66 is located. However, it will be recognized by those skilled in the art in view of the present disclosure that different types of valve assemblies can be utilized, if desired. The recharge nozzle 70 is connected in the path of fluid communication via a fourth tube 78 which extends and connects to the first pipe 24 or to a manifold connected to the first pipe 24, the second pipe 43, the fourth pipe 78 and the open end of the bladder 52, so as to be in fluid communication with the bladder.

As shown in FIG. 9, the hose adapter 80 includes a receptacle 82 for receiving the recharge nozzle assembly 70 of the water gun 10. An external hose attachment, such as a threaded attachment 94 is preferably provided on the hose adapter 80. However, it will be recognized by those skilled in the art from the present disclosure that other types of connectors, such as snap on or quick connect and disconnect connectors, can be provided for attaching the adapter 80 to a pressurized water source, such as a municipal water, through a hose, such as a garden hose, not shown.

A valve body 84 is held in a normally closed position via a spring 86 against a seat 88 located in the receptacle 82 of the adapter 80. The valve body 84 is sealed when in its normally closed position via an O-ring 90. A water channel 92 is located in the valve body 84 and is opened upon downward movement of the valve body 84, caused by the insertion of the front part of the housing 62 of the recharge nozzle assembly 70 of the gun 10 into the receptacle 82 of the adapter 80. Water under pressure enters the water channel 92 and is conveyed through the valve body 84 to the recharge nozzle assembly 70. It will be similarly recognized that different types of valves and actuating mechanisms can be used, if desired. The hose adapter or quick charge device 80 is preferably made from polymeric material in one or more pieces to be assembled. However, it is understood and recognized by those skilled in the art in view of the present disclosure that the hose adapter or quick charge device 80 may be made from any other suitable material, as desired.

For quick charging of the water gun 10, the recharge nozzle assembly 70 is inserted in the receptacle 82 of the hose adapter 80. An O-ring is preferably provided on the exterior wall of the housing 62 of the gun's recharge nozzle assembly 70, or alternatively, on the interior wall of the receptacle 82, to prevent leakage during recharging. Once the valve body 84 has been moved downwardly by the recharge nozzle assembly 70, water under pressure flows through the channel 92 into the recharge opening 61 of the recharge nozzle assembly 70 and forceably moves the gun's charge valve 63 inwardly to open the charge valve 63 and allow pressurized water to flow through the recharge opening 61. Water initially flows through the fourth pipe 78 and into the bladder 52, as well as through the second pipe 43 to the pump valve assembly 56 on the pump 40 and the pressure release valve 58. After the bladder 52 expands with pressurized water, the pressure release valve 58 opens, allowing water to back fill through the manifold 55 and the third pipe 50 into the tank 16. Once the tank 16 is full, water is vented through the opening 19 in the cap 18 and the user withdraws the recharge nozzle assembly housing 62 of the toy gun 10 from the hose adapter 80 with the bladder 52 fully charged and the tank 16 fill. The pressure release valve 58 is set to an opening pressure which is slightly greater than the pressure required to charge the bladder 52. Upon initial depletion of the liquid within the bladder 52, the pump 40 can be utilized to recharge the bladder 52 with liquid from the storage tank 16.

It will be appreciated by those skilled in the art that changes could be made to the embodiment described above without departing from the broad inventive concept thereof. It is understood, therefore, that the invention is not limited to the particular embodiment disclosed, and is intended to cover modifications within the scope and spirit of the present invention, as defined by the appended claims.

What is claimed is:

1. A toy gun for discharging a shaped stream of liquid under pressure, comprising:

a housing;

an expandable bladder located in the housing, the expandable bladder being adapted to provide a generally constant pressure discharge of liquid contained therein;

a trigger connected to a release valve for regulating discharge of liquid from the expandable bladder to a discharge outlet; and a turret mounted rotatable nozzle assembly having a plurality of nozzles connected to the housing, each nozzle having a differently shaped nozzle orifice arrangement and being selectively rotatable to a position in fluid communication with the discharge outlet, wherein actuation of the trigger regulates the release of pressurized liquid through the discharge outlet and the selected one of the plurality of nozzles and wherein the turret mounted rotatable nozzle assembly comprises a turret support member connected to the housing and a turret having a front surface from which the nozzles extend, and a rear surface, the turret being rotatably connected to the turret support member, the turret support member including an orifice through which the liquid is discharged, a seal to minimize leakage between the turret support member and the rear surface of the turret, and a retainer element extending from the turret support member, the retainer element having a rear surface, the turret including a plurality of tabs, each tab being aligned with one of the nozzles and bearing against the rear surface of the retainer element to urge the seal into engagement with the rear surface of the turret, thereby minimizing leakage wherein at least two of the plurality of nozzles including different shaped, non-circular stream nozzle orifice arrangements and wherein actuation of the trigger results in the liquid being discharged in a shaped stream having a generally constant form defined by the shape of the selected nozzle orifice arrangement.

2. The toy gun of claim 1, wherein the turret has a rearwardly extending peripheral side wall and each tab extends radially inwardly from the peripheral side wall a sufficient distance to bear against the retainer element of the turret support member.

3. The toy gun of claim 1, wherein a pump is attached to the housing and in fluid communication with a liquid storage tank, the pump being adapted to transfer liquid from the liquid storage tank to the expandable bladder for charging the expandable bladder such that the bladder is expanded by liquid under pressure as the pump is actuated.

4. The toy gun of claim 1, wherein a recharge nozzle assembly is connected to the housing and in fluid communication with the expandable bladder, the recharge nozzle assembly including a first part adapted for engagement with a charge device connected to an external source of pressurized liquid.

5. The toy water gun of claim 1, wherein at least two of the plurality of nozzles having differently shaped nozzle orifice arrangements have non-circular stream nozzle orifice arrangements and wherein actuation of the trigger results in the liquid being discharged in a shaped stream having a generally constant form defined by the shape of the selected nozzle orifice arrangement.

6. The toy gun of claim 5 wherein the generally constant form of the shape of the liquid stream is maintained for at least about 70% of the range of travel of the discharged liquid from the gun.

7. The toy gun of claim 5 wherein the generally constant form of the shape of the liquid stream is maintained in for at least about 75% of the range of travel of the discharged liquid from the gun.

8. The toy gun of claim 5 wherein the generally constant form of the shape of the liquid stream is maintained for at least about 80% of the range of travel of the discharged liquid from the gun.

9. The toy gun of claim 1, wherein the turret includes at least three shaped stream nozzle orifice arrangements having a non-circular cross-section.

10. The toy gun of claim 1, wherein one of the shaped stream nozzle orifice arrangements includes a plurality of openings arranged to produce a hollow box shaped stream in cross-section.

11. The toy gun of claim 1, wherein one of the shaped stream nozzle orifice arrangements includes a plurality of openings arranged to produce a generally planar fan shaped stream in cross-section.

12. The toy gun of claim 1, wherein, one of the shaped stream nozzle orifice arrangements includes a plurality of openings arranged in a horizontal line to produce a spray of linearly aligned streams in cross-section.

13. The toy gun of claim 1, further including at least one shaped stream nozzle orifice arrangement that includes an opening arranged to produce a generally large diameter circular shaped stream in cross-section.

14. The toy gun of claim 1, wherein the turret mounted rotatable nozzle assembly includes at least five nozzles having at least three different shaped, non-circular stream nozzle orifice arrangements.

15. The toy gun of claim 1, wherein the shaped stream nozzle orifice arrangements each has multiple openings.

* * * * *